US006695467B1

(12) United States Patent
Montag

(10) Patent No.: US 6,695,467 B1
(45) Date of Patent: Feb. 24, 2004

(54) MIXER DRUM LOCKING APPARATUS

(75) Inventor: Patrick H. Montag, Milwaukee, WI (US)

(73) Assignee: M-B-W Inc., Slinger, WI (US)

( * ) Notice: Subject to any disclaimer, the term of this patent is extended or adjusted under 35 U.S.C. 154(b) by 26 days.

(21) Appl. No.: 10/062,690

(22) Filed: Feb. 1, 2002

(51) Int. Cl.[7] ..... B28C 7/16; B01F 15/00
(52) U.S. Cl. ..... 366/47; 366/185
(58) Field of Search ..... 366/45–48, 185; 414/421; 298/17 R, 38; 222/153.01, 153.04, 164, 166

(56) References Cited

U.S. PATENT DOCUMENTS 2,494,119 A * 1/1950 Essick
3,117,820 A * 1/1964 Toland et al.
3,905,519 A * 9/1975 Tertinek et al.
4,509,860 A * 4/1985 Lasar, III
4,699,517 A * 10/1987 Sella
4,895,277 A * 1/1990 Whiteman, Jr.
5,918,975 A * 7/1999 Hotchkiss et al.
5,951,230 A * 9/1999 Kruzick et al.

FOREIGN PATENT DOCUMENTS

GB 2219220 * 12/1989

* cited by examiner

*Primary Examiner*—Charles E. Cooley
(74) *Attorney, Agent, or Firm*—Andrus, Sceales, Starke & Sawall

(57) ABSTRACT

The cylindrical drum of a mortar/plaster mixer is locked in the mixing position by a rotatable pivot arm pivotally attached by one end to an end wall of the drum such that, when the drum is in the mixing position, the arm may be rotated between a locked position with the free end of the arm in locking engagement with the mixer frame to an unlocked position with the arm rotationally displaced from the locking position. As the mixer drum is tilted for discharge, the unlocked arm is further pivotable from the rotationally displaced unlocked position back to the locked position in response to drum rotation from the mixing position to the discharge position and reverse rotation back to the mixing position.

10 Claims, 4 Drawing Sheets

FIG. 3
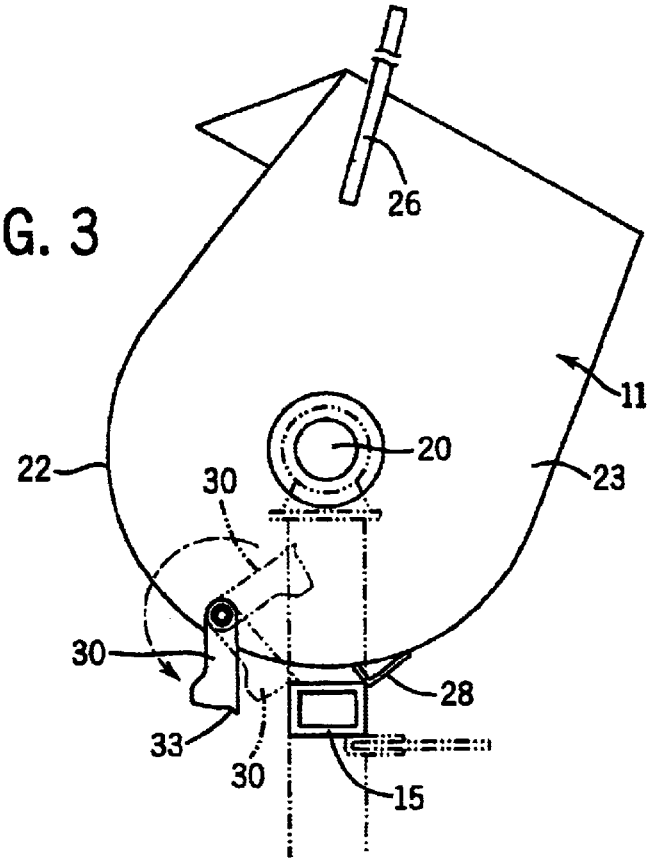
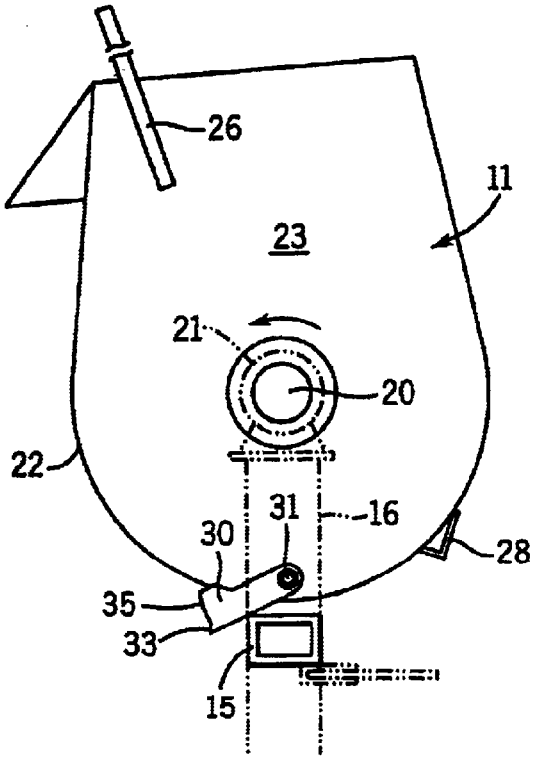
FIG. 4

MIXER DRUM LOCKING APPARATUS

BACKGROUND OF THE INVENTION

The present invention pertains to mixing apparatus for mortar, plaster and the like and, more particularly, to a locking apparatus for preventing inadvertent or unintended rotation of the mixing drum from a mixing to a dumping or discharge position.

Small portable mortar and plaster mixers are well known in the art and typically include a cylindrical or semicylindrical-walled mixing drum supported on a frame for rotation on the drum axis between an upright mixing position and a rotationally tilted dumping position. Also typically, an engine or motor is mounted on the frame adjacent the drum for driving mixing blades or mixing paddles rotatably mounted inside, either on the aids of the drum or on a separate axis parallel to the drum axis. The mixer frame is usually mounted on wheels for trailering and support during operation where a third supporting leg on the trailer tongue provides, with the wheels, three-point support for the mixer.

The ingredients for a desired mix are dumped into the open top and, after mixing, a dumping lever attached to the drum is pulled by the operator to rotate the drum on its axis until the mix can be dumped by gravity, supplemented by continued rotation of the mixing paddles, out of the open portion of the drum. After dumping, the operator reverses the force on the lever arm and rotates the drum in a reverse direction to the original mixing position where, typically, a stop on the drum surface engages the mixer frame to prevent further reverse rotation beyond the mixing position.

In order to prevent inadvertent rotation of the drum from the mixing position, a manually releasable locking device is often mounted on the frame from which it extends into locking engagement with the drum. One very common type of prior art locking mechanism comprises a spring loaded pin mounted on a vertical frame member adjacent one flat end wall of the drum and which is biased into engagement with a stop on the drum wall. To unlock the pin, the operator pulls against the bias of the spring, generally in a direction parallel to the axis of drum rotation. However, the operator must also simultaneously engage the dumping lever with the other hand and begin to tilt the drum for discharge before the spring biased locking mechanism is released. The two separate motions required of the operator are in perpendicular directions, making it difficult for the operator to tilt the drum. The force required to tilt the drum from the mixing to the discharge position is compounded by rotation of the mixing paddles which place a torque on the drum in the opposite reverse rotational direction. As a result, it is not uncommon for the operator to be required to use both arms to engage the tilt lever arm and rotate the drum. Therefore, another person may be required to unlock the locking device. Worse yet, to avoid the use of another workman, there may be the temptation to disenable the locking device entirely.

Therefore, a simple, yet effective mixer drum locking apparatus that can be operated by one person would be most desirable. The locking device should enable the operator, if necessary, to grasp the drum tilt lever with two hands for tilting discharge. Furthermore, the locking device should be automatically operable to relock the drum when it is returned to the mixing position.

SUMMARY OF THE INVENTION

In accordance with the present invention, a locking arm is pivotally attached by one end to the mixer drum for rotation on a pivot axis that is generally parallel to the rotational axis of the drum. When the drum is in the generally upright mixing position, the arm is pivotable between a locked position where the opposite end of the arm is in locking engagement with the frame to an unlocked position where the arm is rotationally displaced from the locking position. The arm is further pivotable from the rotationally displaced unlocked position back to the locked position in response to reciprocal drum rotation in a first direction from the mixing position to the dumping position and reverse rotation back to the mixing position. The drum may also include a stop device that is engageable with the frame to prevent reverse rotation of the drum past the mixing position.

In the preferred embodiment, the frame extends under the mixer drum and the locking arm is mounted to rotate freely on its pivot axis and, when in the locked position, the pivot axis is positioned up from the frame with respect to drum rotation in the first direction. The opposite end of the locking arm includes a locking tooth that engages the fame in the locked position and prevents arm rotation in one direction. The locking arm also includes an abutment surface positioned adjacent the locking tooth and adapted to engage the frame in the locked position. Preferably, when in the locked position, the locking arm extends angularly downwardly from the pivot and the locking tooth rests by gravity on the frame.

In the preferred embodiment, the mixer drum includes a pair of opposite end walls that enclose the cylindrical outer wall and a mixing device mounted for rotation in the drum. The frame includes a generally horizontal frame member positioned under the drum and extending generally parallel to the drum axis. The locking arm is pivotally attached to one of the end walls. In the preferred arrangement, the locking arm includes an abutment surface on the opposite end which is positioned to engage the frame member in the locked position and a locking tooth on the end of the arm positioned above the abutment surface and adapted to rest by gravity on the frame member in the locked position. A stop device is mounted on the drum and is engageable with the frame to prevent reverse rotation of the drum past the mixing position. Preferably, the locking tooth engages a frame member surface along a tooth flank of a given length, and the stop device is positioned to prevent reverse rotation of the drum from the locked position by a distance greater than the length of the tooth flank.

BRIEF DESCRIPTION OF THE DRAWINGS

FIG. 3 is a view similar to FIG. 2 showing the mixing drum in the mixing position and sequential rotation of the locking arm from the locked to the unlocked position.

FIGS. 4 and 5 show the sequence of dumping rotation of the mixer drum and the initial rotation of a locking arm to the fully dumped position.

DETAILED DESCRIPTION OF THE PREFERRED EMBODIMENT

Figure 1:
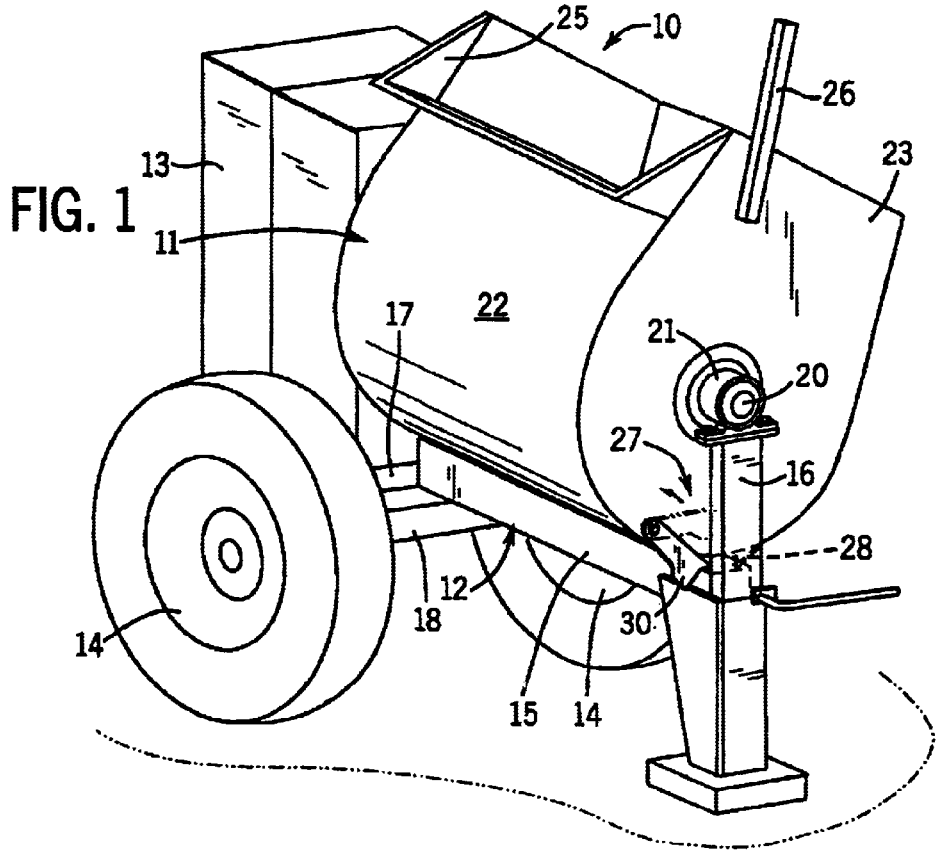
FIG. 1 is an isometric view of a mixer including the drum locking apparatus of the present invention.
Figure 2:
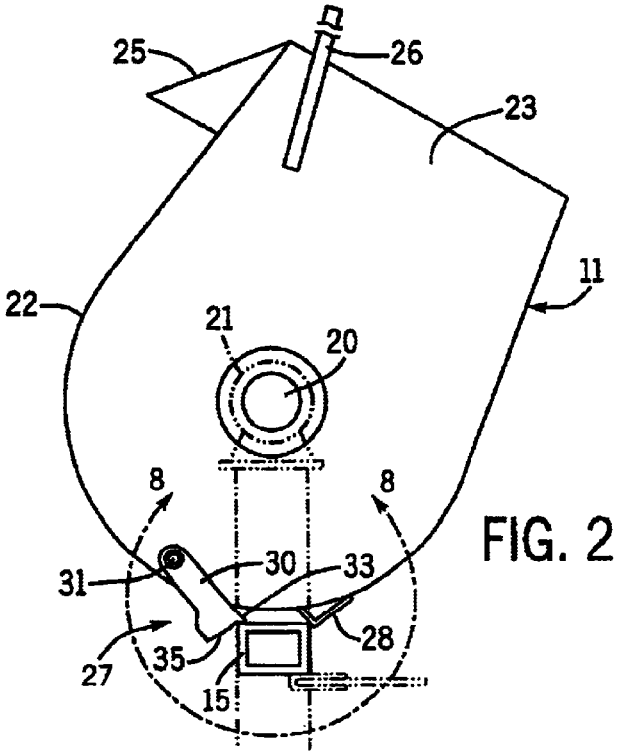
FIG. 2 is a slightly enlarged end view of a portion of the mixer shown in FIG. 1 with the drum locked in the mixing position.

Referring first to FIGS. 1 and 2, a mortar and plaster mixer 10 includes a mixer drum 11, a supporting frame 12, a mixer drive 13, and a pair of support/transport wheels 14. The frame 12 includes a main horizontal frame member 15, a main vertical frame member 16 attached to one end of the horizontal member 15, and a frame platform 17 that supports the mixer drive 13 and the wheel axle 18. The mixer drive 13 is operably connected to one end of a main shaft 20 that extends through the interior of the drum 11 and is rotatably supported at its opposite end by a bearing 21 mounted on the upper end of the vertical frame member 16. Inside the drum 11, the shaft 20 carries mixing blades that are rotatable within the drum, all in a manner well known in the art.

The mixer drum 11 has a generally cylindrical outer wall 22 that is enclosed by two opposite end walls 23. The cylindrical outer wall 22 and end walls 23 extend in an upward direction to define an open upper end that is typically covered by a grill (not shown) which covers a discharge chute 25. The drum is journaled for rotation on the shaft 20 so it can be tilted for discharge from the mixing position shown in FIGS. 1 and 2 to a dumping position by an operator grasping the upper end of a tilt handle 26 and rotating the drum in a counterclockwise direction as viewed in the drawings. In some mixers, the drum is mounted for rotation on an axis offset from the mixing blade shaft.

To prevent inadvertent or unintended tilting of the mixer drum 11, either in transit or while operating, the drum is locked in the mixing position. The locking apparatus 27 of the present invention operates to lock the drum against rotation from the mixing position to the dumping position, as will be described in detail hereinafter. In a manner well known in the art, the drum is also held against reverse rotation from the mixing position in a direction opposite the discharge position. Thus, a back stop 28 which may comprise a section of a steel angle member is welded to the underside of the cylindrical outer wall 22 of the drum in a position where it engages the back side of the horizontal frame member 15 as the drum is rotated from a dumping position back to the mixing position, the back stop 28 acting to prevent further rotation in that reverse or return direction. It should be noted that some mixer constructions do not utilize a separate back stop, but rather use a common locking device which, when engaged, prevents rotation of the drum in either direction.

The locking apparatus 27 of the present invention, on the other hand, operates to lock the mixing drum in the mixing position until the operator desires to discharge the mix, at which point the apparatus is unlocked, either by the operator's hand or foot, and the operator is then free to use both hands, if necessary, to grasp the tilt handle 26 for discharge rotation of the drum 11. Referring particularly to FIGS. 2 and 3, the mixer drum 11 is shown in the mixing position and the locking apparatus 27 is in the locked position. A locking arm 30, preferably made of heavy bar stock, is pivotally attached at one end to the cylindrical end wall 23 close to its juncture with the cylindrical outer wall 22. The pivotal connection may comprise a simple bolt 31 threaded into a tapped hole in the end wall 23, the bolt extending through a clearance hole in the arm 30 and backed by a washer 32, so the arm is fee to rotate on an axis defined by the bolt 31. Because the flat end walls 23 are perpendicular to the axis of the main shaft 20, the axis of the pivot bolt 31 is parallel to the axis of the shaft 20. The free end of the locking arm, opposite the pivot bolt 31, includes a locking tooth 33 at the upper end of an end face 34 when the arm is in the locked position. A portion of the end face 34 immediately adjacent to and below the locking tooth 33 forms an abutment surface 35. In the locked position, the abutment surface 35 engages the horizontal frame member 15, and contact of the locking tooth 33 with the horizontal member 15 prevents the locking arm from rotating downwardly out of its locked position under the influence of gravity. In the locked position of the drum 11, the locking tooth 33 has a downwardly facing tooth flank 36 of a given length, and the back stop 28 is positioned to prevent reverse rotation of the drum from the locked position by a distance more than the length of the tooth flank 36.

When it is desired to discharge the contents of the mixer, the operator simply lifts the locking arm 30 from the locked position by rotating it in a counterclockwise direction as shown by the arrow in FIG. 3. The operator may utilize a hand or a foot to unlock the locking arm which, as shown in FIG. 3, is continued to be rotated to a position where the arm 30 hangs vertically downwardly by gravity. It should be noted that the mixing arms inside the drum are typically driven in the clockwise direction as viewed in the figures and the resulting torque imposed on the mixer drum 11 tends to cause the drum to rotate in the same direction. This rotation is prevented by contact of the back stop 28 with the horizontal frame member 15, but it also tends to keep the abutment surface 35 of the locking arm from binding tightly against the frame member, thereby permitting it to be easily unlocked by rotation as indicated above.

Figure 5:
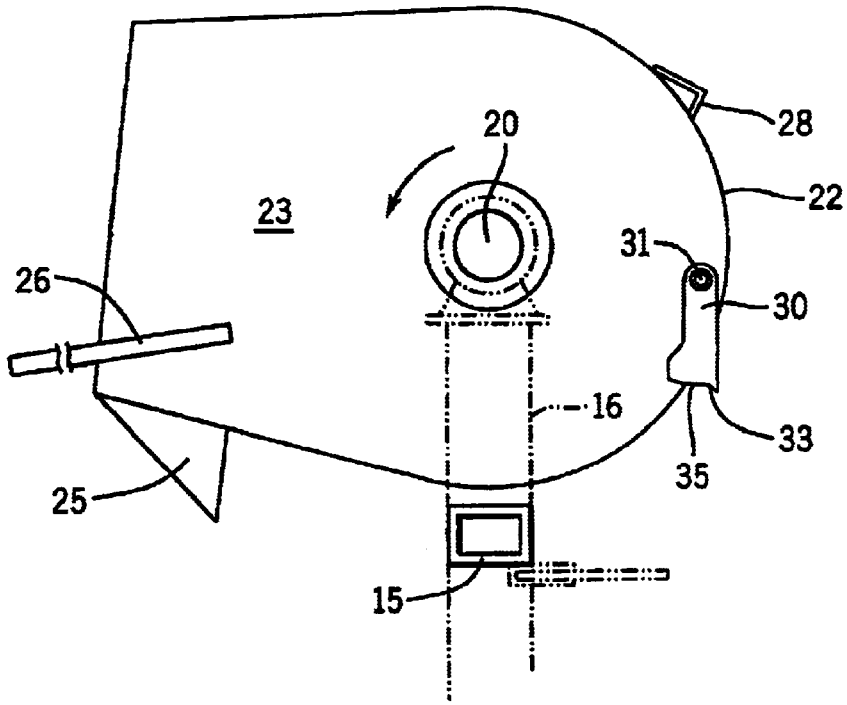

Once the mixer drum has been unlocked, the operator may grasp the tilt handle 26 and rotate the drum in a counterclockwise direction as shown in the sequence of FIGS. 4 and 5, until the discharge chute 25 is low enough to permit the contents to be dumped. As is known in the art, discharge may be assisted by continued rotation of the mixing device inside the drum. As the drum is rotated toward the full discharge position of FIG. 5, one edge of the freely suspended locking arm 30 will initially engage the horizontal frame member 15 (FIG. 4) and, as rotation of the drum continues, the locking arm will ride over the frame member until it is free of contact and is again hanging vertically downwardly by gravity (FIG. 5).

Figure 6:
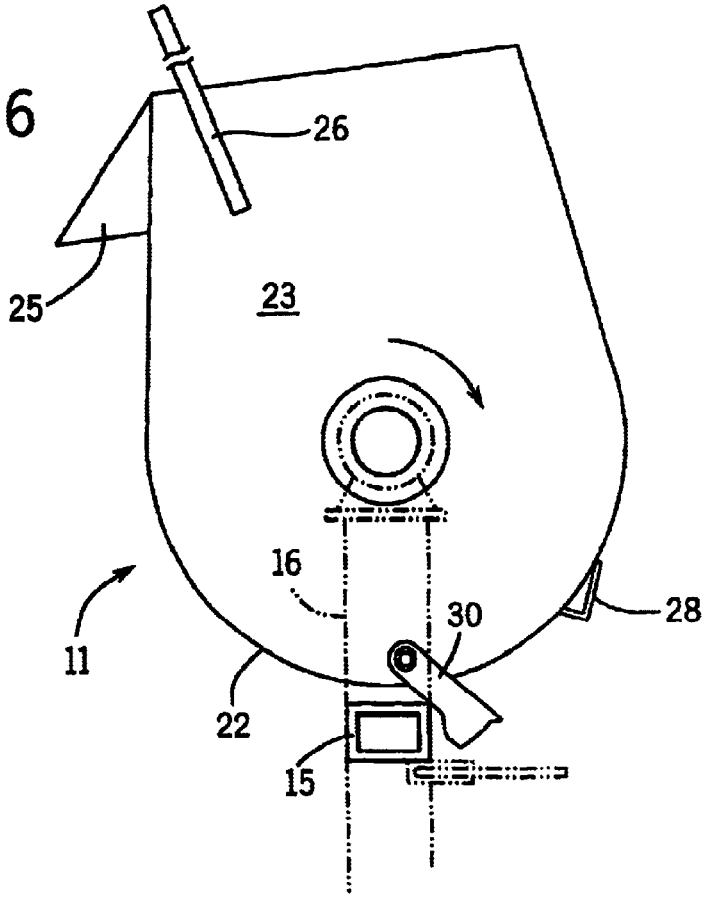
FIGS. 6 and 7 show the sequence of reverse rotation of the mixer drum from the full dumping position of FIG. 5 to the mixing position with the corresponding rotational movement of the locking arm to the initial locked position of FIG. 2.
Figure 7:
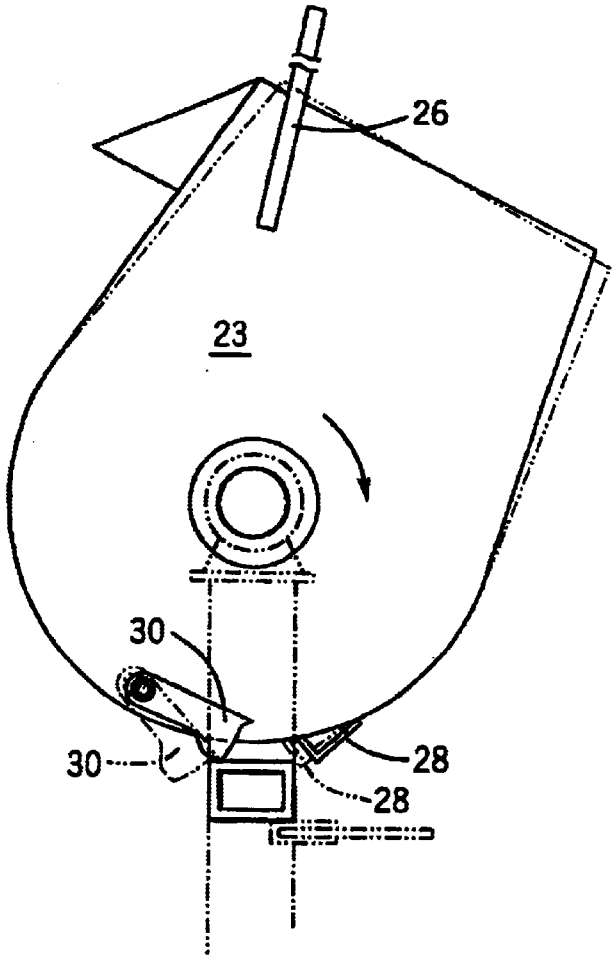

After the mixer drum has been unloaded, the drum is rotated in the reverse (clockwise) direction and the other edge of the locking arm 30 will eventually engage the horizontal frame member (FIG. 6) ride over it, and as the end face 34 of the locking arm passes the frame member 15, the arm will drop by gravity and the flank 36 of the locking tooth 33 will engage the frame member 15 to again establish the locked position (FIG. 7).

Figure 8:
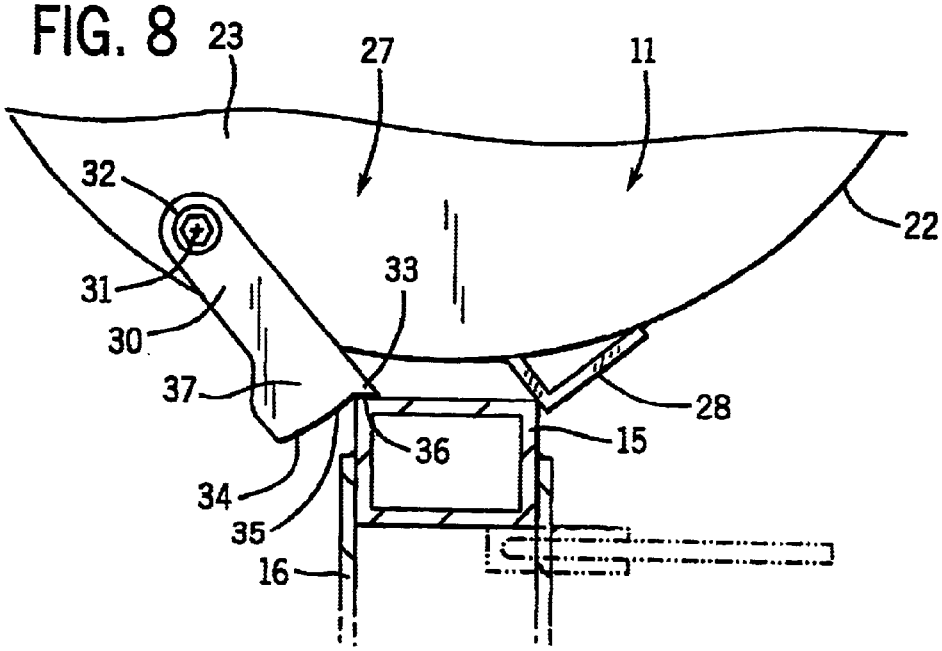
FIG. 8 is an enlarged detail of the drum locking mechanism in the locked position of FIG. 2.

The FIG. 7 locked position (shown in phantom) corresponds, of course, to the locked position of FIG. 2. Reverse clockwise rotation of the mixer drum 11 beyond the locked position is prevented by the back stop 28, as previously described. Referring to FIG. 8, the locking arm 30 is preferably provided with a widened free end 37 to provide a substantial length for the abutment surface 35 and to add significant additional mass to the arm. The added mass tends to help hold the locking arm in the locked position against vibration or bouncing which may occur as a result of mixer operation or bumps encountered as the mixer is being trailered.

I claim:

1. A mixer drum and drum locking apparatus said mixer drum having generally cylindrical outer wall and rotatably mounted on a horizontal axis and supported on a frame for rotational movement on its axis between a mixing position and a dumping position, said apparatus further comprising:

a locking arm pivotally mounted by one end on the drum for rotation on a pivot axis disposed parallel to the rotational axis of the drum, said arm being pivotable when the drum is in the mixing position between a locked position with the opposite end of the arm in locking engagement with the frame to an unlocked position with the arm rotationally displaced from the locking position, said arm being further pivotable from the rotationally displaced unlocked position to the locked position in response to reciprocal drum rotation in a first direction from the mixing position to the dumping position and reverse rotation back to the mixing position.

2. The apparatus as set forth in claim 1 wherein said drum includes a stop device engageable with the frame to prevent reverse rotation of the drum past the mixing position.

3. The apparatus as set forth in claim 1 wherein said fame extends under the drum, said locking arm is mounted to rotate freely on the pivot axis, and said pivot axis in the locked position is positioned upstream from the frame with respect to drum rotation in the first direction.

4. The apparatus as set forth in claim 3 wherein the opposite end of the locking arm includes a locking tooth that engages the frame in the locked position and prevents arm rotation in one direction.

5. The apparatus as set forth in claim 4 wherein the locking arm includes an abutment surface adjacent the locking tooth and positioned to engage the frame in the locked position.

6. The apparatus as set forth in claim 5 wherein the locking arm in the locked position extends angularly downwardly from the pivot axis and the locking tooth rests by gravity on the frame.

7. The apparatus as set forth in claim 1 wherein said drum includes a pair of opposite end walls enclosing said cylindrical outer wall, said frame includes a generally horizontal frame member positioned under the drum and extending generally parallel to the drum axis, and said locking arm is pivotally attached to one of said end walls.

8. The apparatus as set forth in claim 7 wherein said locking arm comprises:

an abutment surface on said opposite end positioned to engage the frame member in the locked position; and a locking tooth on said opposite end above said abutment surface and positioned to rest by gravity on the frame member in the locked position.

9. The apparatus as set forth in claim 8 including a stop device mounted on the drum and engageable with the frame to prevent reverse rotation of the drum past the mixing position.

10. The apparatus as set forth in claim 9 wherein the locking tooth engages a frame member surface along a tooth flank of a given length, and said stop device is positioned to prevent reverse rotation of the drum from the locked position by a distance greater than the length of said tooth flank.

* * * * *